US005379408A

United States Patent [19]

Izzi et al.

[11] Patent Number: 5,379,408

[45] Date of Patent: Jan. 3, 1995

[54] COLOR PALETTE TIMING AND CONTROL WITH CIRCUITRY FOR PRODUCING AN ADDITIONAL CLOCK CYCLE DURING A CLOCK DISABLED TIME PERIOD

[75] Inventors: Louis J. Izzi, Plano; William R. Krenik, Garland, both of Tex.

[73] Assignee: Texas Instruments Incorporated, Dallas, Tex.

[21] Appl. No.: 789,725

[22] Filed: Nov. 8, 1991

[51] Int. Cl.[6] ..... C06F 1/00; C06F 1/04

[52] U.S. Cl. ..... 395/550; 395/162; 364/DIG. 1; 364/270; 364/270.3; 364/270.4

[58] Field of Search ..... 395/550, 750, 162; 364/270.3, 270.4, 934.2, 934.3; 365/213

[56] References Cited

U.S. PATENT DOCUMENTS

| | | | |
|---|---|---|---|
| 4,686,386 | 8/1987 | Tadao | 395/550 |
| 4,769,632 | 9/1988 | Work et al. | 340/701 |
| 4,815,033 | 3/1989 | Harris | 364/900 |
| 4,881,205 | 11/1989 | Aihara | 365/222 |
| 5,099,140 | 4/1992 | Mudgett | 307/269 |
| 5,155,840 | 10/1992 | Niijima | 395/550 |
| 5,227,863 | 7/1993 | Bilbrex et al. | 358/22 |
| 5,287,100 | 2/1994 | Guttag et al. | 345/213 |

OTHER PUBLICATIONS

Brocktree, "B7459", *Product Data Book 1989,* 1989 pp. S-85-115.

Texas Instruments Incorporated, "7US34070-20 Color Pallette" *Production Data,* 1986, pp. 1-15.

Brooktree, "Ramdal Products" *Winter 1990 Product Selection Guide* Winter, 1990, pp. 9-15.

*Primary Examiner*—Thomas C. Lee
*Assistant Examiner*—D. Dinh
*Attorney, Agent, or Firm*—Robert D. Marshall, Jr.; James C. Kesterson; Richard L. Donaldson

[57] ABSTRACT

A clock control circuit 84 is provided which includes circuitry 98 for selecting a master clock from among at least two input clocks provided to clock control circuit 94, the selection made in response to master clock selection control signals. Circuitry 104 is coupled to circuitry for selecting 98 for providing at least first and second divided down clocks each being of a different divide ratio of the master clock. Circuitry 108 is coupled to circuitry for providing divided down clocks 104 for selecting an output clock from between at least the first and second divided down clocks in response to output clock selection control signals received by clock control circuit 84. Circuitry 120 is provided coupled to circuitry for selecting an output clock 108 for selectively controlling the output of the output clock, circuitry for controlling output clock 120 enabling output of the output clock in response to a first output clock control signal received by clock control circuitry 84 and disabling output of the output clock in response to a second output clock output control signal received by clock control circuit 84. Circuitry 120 is further operable to selectively output an additional output clock cycle in response to a control signal during a period when circuitry for controlling 120 has disabled output of the output clock.

25 Claims, 13 Drawing Sheets

COLOR PALETTE TIMING AND CONTROL WITH CIRCUITRY FOR PRODUCING AN ADDITIONAL CLOCK CYCLE DURING A CLOCK DISABLED TIME PERIOD

CROSS-REFERENCE TO RELATED APPLICATION

U.S. patent application Ser. No. 07/544,775, abandoned entitled "PACKED BUS SELECTION OF MULTIPLE PIXEL DEPTHS IN PALETTE DEVICES, SYSTEM AND METHODS";

U.S. patent application Ser. No. 07/734,344, entitled "TEST CIRCUITRY, SYSTEMS AND METHODS";

U.S. patent application Ser. No. 07/720,100, abandoned entitled "SEQUENTIAL ACCESS MEMORIES, SYSTEMS AND METHODS";

U.S. patent application Ser. No. 07/723,342, U.S. Pat. No. 5,309,173 entitled "AN IMPROVED FRAME BUFFER, SYSTEMS AND METHODS";

U.S. patent application Ser. No. 07/544,779, U.S. Pat. No. 5,341,470 entitled "COMPUTER GRAPHICS SYSTEMS, PALETTE DEVICES AND METHODS FOR SHIFT CLOCK PULSE INSERTION DURING BLANKING";

U.S. patent application Ser. No. 07/545,422, U.S. Pat. No. 5,270,689 entitled "PALETTE DEVICES, COMPUTER GRAPHICS SYSTEMS AND METHODS WITH PARALLEL LOOK-UP AND INPUT SIGNAL SPLITTING";

U.S. patent application Ser. No. 07/544,774, abandoned entitled "PALETTE DEVICES, SYSTEMS AND METHODS FOR TRUE COLOR MODE";

U.S. patent application Ser. No. 07/545,421, U.S. Pat. No. 5,309,551 entitled "DEVICES, SYSTEMS AND METHODS FOR PALETTE PASS THROUGH MODE";

U.S. patent application Ser. No. 07/544,771, abandoned entitled "INTEGRATED CIRCUIT INTERNAL TEST CIRCUITS AND METHODS";

U.S. patent application Ser. No. 07/545,424, U.S. Pat. No. 5,287,100 entitled "GRAPHICS SYSTEMS, PALETTES AND METHODS WITH COMBINED VIDEO AND SHIFT CLOCK CONTROL", all of the above are assigned to Texas Instruments Incorporated, the assignee of the present application, and are cross-referenced and incorporated into the present application by reference herein.

TECHNICAL FIELD OF THE INVENTION

The present invention relates in general to graphics processors and in particular to color palette timing control circuitry, systems and methods.

BACKGROUND OF THE INVENTION

Without limiting the general scope of the invention, its background is described in connection with computer graphics, as an example only.

In computer graphics systems, the low cost of dynamic random access memories (DRAM) has made it economical to provide a bit map or pixel map system memory. In such a bit map or pixel map memory, a color code is stored in a memory location corresponding to each pixel to be displayed. A video system is provided which recalls the color codes for each pixel and generates a raster scan video signal corresponding to the recalled color codes. Thus, the data stored in the memory determine the display by determining the color generated for each pixel (picture element) of the display.

The requirement for a natural looking display and the minimization of required memory are conflicting. In order to have a natural looking display, it is necessary to have a large number of available colors. This, in turn, necessitates a large number of bits for each pixel in order to specify the particular color desired from among a large number of possibilities. The provision of a large number of bite per pixel, however, requires a large amount of memory for storage. Since a number of bits must be provided for each pixel in the display, even a modest size display would therefore require a large memory. Thus, it is advantageous to provide some method to reduce the amount of memory needed to store the display while retaining the capability of choosing among a large number of colors.

The provision of a circuit called a color palette enables a compromise between these conflicting requirements. The color palette stores color data words which specify colors to be displayed in a form that is ready for digital-to-analog conversion directly from the color palette. Corresponding color codes having a limited number of bits are stored in the memory for each pixel have a limited number of bits, thereby reducing the memory requirements. The color codes are employed to select one of a number of color registers or palette locations. Thus, the color codes do not themselves define colors, but instead, identify preselected palette locations. These color registers or palette locations each store color data words which are longer than the color codes in the pixel map memory. The number of such color registers or palette locations provided in the color palette is equal to the number of selections provided by the color codes. For example, a 4-bit color code can be used to select $2^4$ or 16 palette locations. Significantly, the color data words can be redefined in the palette from frame to frame to provide many more colors in an ongoing sequence of frames than are present in any one frame. Significantly, the ability to redefine the color data words in the palette allow for the customization of colors on the display from one application to another.

Due to the advantages of color palette devices, systems and methods, any improvement in their implementation is advantageous in computer graphics technology.

SUMMARY OF THE INVENTION

According to the invention, a clock control circuit is provided which includes circuitry for selecting a master clock from at least two input clocks provided to the clock control circuit, the selection made in response to master clock selection control signals received by the clock control circuit. Circuitry is coupled to the circuitry for selecting the master clock for providing at least first and second divided down clocks, each of the first and second clocks being of a different divide ratio of the master clock. Circuitry is also coupled to the circuitry for providing divided down clocks for selecting an output clock from between at least the first and second divided down clocks. In response to output clock selection control signals received by the clock control circuit. Further, circuitry is provided coupled to the circuitry for selecting an output clock for selectively controlling the output of the output clock, the circuitry for the output clock enabling output of the output clock in response to a first output clock output control signal received by the clock control circuitry and disabling output of the output clock in response to a second output clock control signal received by the clock control circuit. Finally, circuitry is provided coupled to the circuitry for controlling for selectively outputing a split shift register transfer output clock cycle during a period when said circuitry for controlling has disabled output of said output clock.

The present invention provides significant advantages over previously available color palette clock control circuitry. In the illustrated embodiment, the circuitry according to the present invention allows for the selection of a master clock for the color palette from among at least two clocks provided by external clock sources. Further, the present circuitry allows for the selection of between at least two possible output clocks which have two different divide ratios of the input clock. Further, when used in a color palette operating in a graphics processing system, circuitry is provided for disabling the shift clock during the blanking period for the associated graphics display. Finally, when used in conjunction with a video random access memory having split shift register transfer capability, the present invention allows for the output of an additional shift clock pulse necessary for proper timing in the video random access memory.

BRIEF DESCRIPTION OF THE DRAWING

For a more complete understanding of the illustrated embodiments of the present invention, and the advantages thereof, reference is now made to the following descriptions, taken in conjunction with the accompanying drawings, in which:

FIGS. 18–26 depict sub-blocks of the circuitry shown in FIGS. 5–17.

DETAILED DESCRIPTION OF THE INVENTION

The preferred embodiment of the present invention and its advantages are best understood by referring to FIGS. 1–12 of the drawings, like numerals being used for like and corresponding parts of the various drawings.

Figure 1:
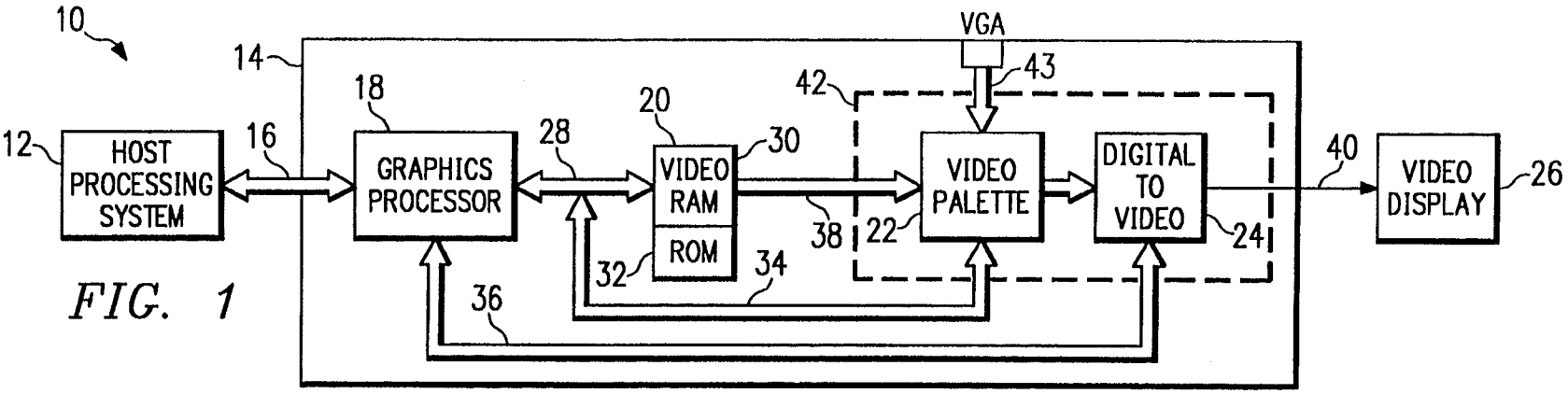
FIG. 1 is a functional block diagram of a graphics processor system utilizing one embodiment of the present invention.

Referring first to FIG. 1, a block diagram of a graphics computer system 10 is depicted as constructed in accordance with the principles of the illustrated embodiment of the present invention. For clarity and brevity in understanding the inventive concepts herein, a detailed description of the complete graphics processing system will not be provided. A more complete detailed discussion, however, can be found in patent application Ser. No. 07/544,775 filed Jun. 24, 1990, assigned to the assignee of the present application and hereby incorporated by reference. Also incorporated by reference herein are Texas Instruments TMS 34010 User's Guide (August 1988); TIGA-340 (TM) Interface, Texas Instruments Graphics Architecture, User's Guide, 1989; TMS 34020 User's Guide (January 1990); TMS 44C251 Specification; TMS 34010 Graphics System Processor Products Application Guide, Texas Instruments, 1988; Texas Instruments 340 Family Third Party Guide (June 1990); and Texas Instruments Graphics Systems Primer, 1989, all of which documents are currently available to the general public from Texas Instruments Incorporated. These documents give a more thorough description of graphics processing systems in general.

Graphics computer system 10 includes a host processing system 12 coupled to a graphics printed wiring board 14 through a bidirectional bus 16. Located on printed wiring beard 14 are a graphics processor 18, memory 20, a video palette 22 and a digital-to-video converter 24. Video display 26 is driven by graphics board 14.

Most processing system 12 provides the major computational capacity for graphics computer system 10 and determines the content of the visual display to be presented to the user on video display 26. The details of the construction of host processing system 12 are conventional in nature and known in the art and therefore will not be discussed in further detail herein.

Graphics processor 18 provides the data manipulation capability required to generate the particular video display presented to the user. Graphics processor 18 is bidirectionally coupled to processing system 12 via bus 16. While graphics processor 18 operates as a data processor independent of host processing system 12, graphics processor 18 is fully responsive to requests output from host processing 12. Graphics processor 18 further communicates with memory 20 via video memory bus 28. Graphics processor 12 controls the data stored within video RAM 30, RAM 30 forming a portion of memory 20. In addition, graphics processor 18 may be controlled by programs stored in either video RAM 30 or in read-only memory 32. Read-only memory 32 may also include various types of graphic image data, such as alpha numeric characters in one or more font styles and frequently used icons. Further, graphics processor 12 controls data stored within video palette 22 via bidirectional bus 34. Finally, graphics processor 18 controls digital-to-video converter 24 via video control bus 36.

Video RAM 30 contains bit map graphic data which control the video image presented to the user as manipulated by graphics processor 18. In addition, video data corresponding to the current display screen are output from video RAM 30 on bus 38 to video palette 22. Video RAM 30 may consist of a bank of several separate random access memory integrated circuits, the output of each circuit typically being only one or 4 bits wide as coupled to bus 38.

Video palette 22 receives high speed video data from video random access memory 30 via bus 38 and data from graphics processor 18 via bus 34. In turn, video palette 22 converts the data received on bus 38 into a video level which is output on bus 40. This conversion is achieved by means of a look-up table which is specified by graphics processor 18 via video memory bus 34. The output of video palette 22 may comprise color, hue and saturation signals for each picture element or may comprise red, green and blue primary color levels for each pixel. Digital-to-video converter 24 converts the digital output of video palette 22 into the necessary analog levels for application to video display 26 via bus 40.

Printed wiring board 14 also includes a VGA pass-through port 43 coupled to palette 42. In the VGA pass-through mode, data from the VGA connector of most VGA supported personal computers is fed directly into palette 42 without the need for external data multiplexing. This allows a replacement graphics board to remain "downward compatible" utilizing the existing graphic circuitry often located on the mother board of the associated host processing system 12.

Video palette 22 and digital-to-video converter 24 may be integrated together to form a "programmable palette" 42 or simply "palette" 42. The palette RAM, discussed below, is often referred to as the "look-up" table.

Video display 26 receives the video output from digital-to-video converter 24 and generates the specified video image for viewing by the user of graphics computer system 10. Significantly, video palette 22, digital-to-video converter 24 and video display 26 may operate in accordance with either of two major video techniques. In the first technique, video data are specified in terms of color, hue and saturation for each individual pixel. In the second technique, the individual primary color levels of red, blue and green are specified for each individual pixel. Upon selection of the desired design using either of these two techniques, video palette 22, digital-to-video converter 24 and video display 26 are customized to implement the selected technique. However, the principles of the present invention in regard to the operation of the graphics processor 18 are unchanged regardless of the particular design choice of the video technique. All of the signals that contribute to display color in some way are regarded as color signals even though they may not be of the red, blue, green technique.

Figure 2:
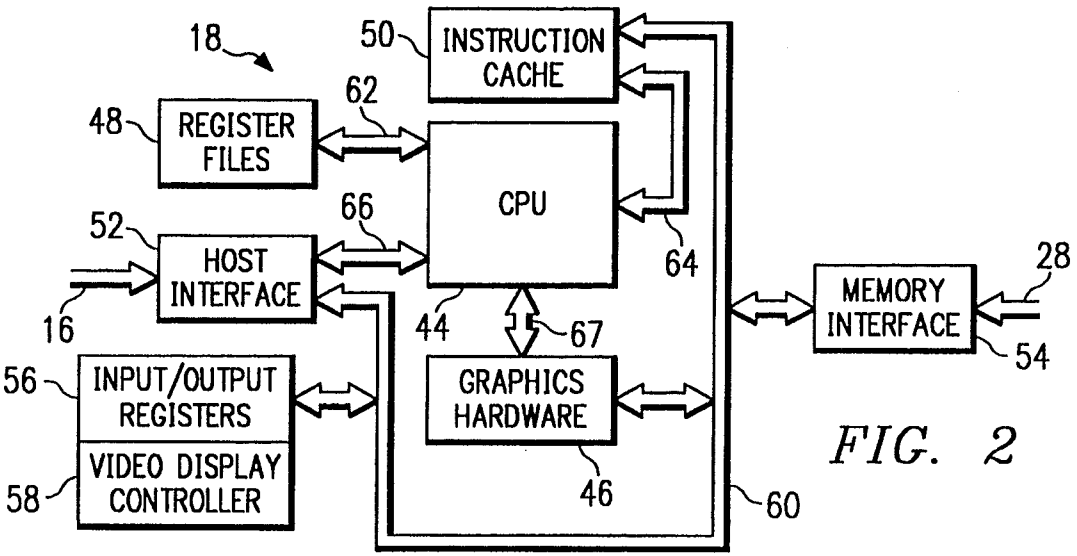
FIG. 2 is a more detailed functional block diagram of a graphics processor for use with the invention.

FIG. 2 generally illustrates graphics processor 18 in further detail. Graphics processor 18 includes central processing unit 44, graphics hardware 46, register files 48, instruction cache 50, host interface 52, memory interface 54, input/output registers 56 and video display controller 58.

The central processing unit 44 performs a number of general purpose data processing functions including arithmetic and logic operations normally included in a general purpose central processing unit. In addition, central processing unit 44 controls a number of special purpose graphics instructions, either alone or in conjunction with graphics hardware 46.

Graphics processor 18 includes a major bus 60 which is connected to most parts of graphics processor 18, including central processing unit 44. Central processing unit 44 is bidirectionally coupled to a set of register files 48, including a number of data registers, via bidirectional register bus 62. Register files 48 serve as the repository of the immediately accessible data used by central processing unit 44.

Central processing unit 44 is also connected to instruction cache 50 by instruction cache bus 64. Instruction cache 50 is further coupled to bus 60 and may be loaded with instruction words from video memory 20 (FIG. 1) via video memory bus 28 and memory interface 54. The purpose of instruction cache 50 is to speed up the execution of certain functions of central processing unit 44. For example, a repetitive function that is often used within a particular portion of the program executed by central processing unit 44 may be stored within instruction cache 50. Access to instruction cache 50 via instruction cache bus 64 is much faster than access to video memory 20 and thus, the overall program executed by central processing unit 44 may be sped up by a preliminary loading of the repeated or often used sequences of instructions within instruction cache 50.

Host interface 52 is coupled to central processing unit 44 via host interface bus 66. Most interface 52 is further connected to host processing system 12 via host system bus 16. Most interface 52 serve to control the communications between host processing system 16 and graphics processor 18. Typically, host interface 52 would communicate graphics requests from the host processing system 16 to graphics processor 18, enabling host system 16 to specify the type of display to be generated by video display 26 and causing graphics processor 18 to perform a desired graphic function.

Central processing unit 44 is further coupled to graphics hardware 46 via graphics hardware bus 68. Graphics hardware 46 is additionally connected to major bus 60. Graphics hardware 46 operates in conjunction with central processing unit 44 to perform graphic processing operations. In particular, graphics hardware 46 under control of central processing 44 is operable to manipulate data within the bit map portion of video RAM 30.

Memory interface 54 is coupled to bus 60 and further coupled to video memory bus 28. Memory interface 54 serves to control the communication of data and instructions between graphics processor 18 and memory 20. Memory 20 includes both the bit map data to be displayed on video display 26 and the instructions and data necessary for the control and operation of graphics processor 18. These functions include control of the timing of memory access, and control of data and memory multiplexing.

Graphics processor 18 also includes input/output registers 56 and a video display controller 58. Input/output registers 56 are bidirectionally coupled to bus 60 to enable reading and writing within these registers. Input/output registers 56 are preferably within the ordinary memory space of central processing unit 44. Input/output registers 56 contain data which specify the control parameters of video display controller 58. In accordance with the data stored within the input/output registers 56, video display controller 58 controls the signals on video control bus 36 for the desired control of palette 42. For example, data within input/output registers 56 may include data for specifying the number of pixels per horizontal line, the horizontal synchronization and blanking intervals, the number of horizontal lines per frame and the vertical synchronization and blanking intervals.

Figure 3:
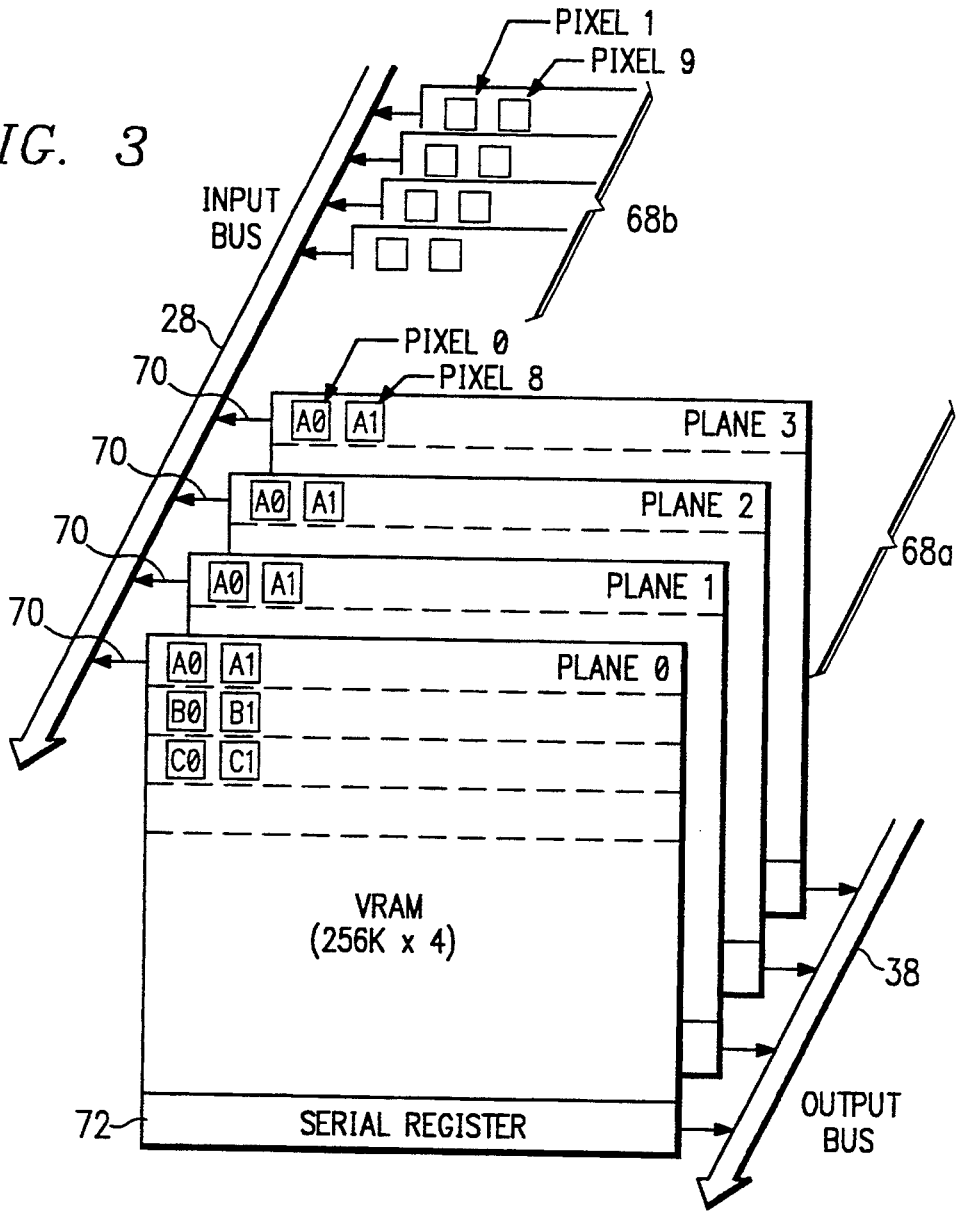
FIG. 3 is a schematic diagram depicting a preferred architecture for video RAM depicted in FIG. 1.

Referring next to FIG. 3 a typical graphics memory system configuration for video RAM 20 is depicted in which eight VRAM memories 68 are used as an array, two of which are depicted as 68*a* and 68*b*. Each VRAM memory 68, or unit, includes four sections, or planes, 0, 1, 2 and 3. The construction of each plane is such that a single data lead 70 is used to write information to that plane. In a system which uses a 32-bit data bus, such as data bus 28, there would be eight VRAM memories, each VRAM memory having four data leads connected to the input data bus. For example, for 32-bit data bus 28, VRAM memory 68*a* would have its four data leads 70 connected to data bus 28 leads 0, 1, 2, and 3, respectively. Likewise, the next VRAM memory 68*b* would have its four leads 0, 1, 2, and 3 connected to data bus 28 leads 4, 5, 6, and 7, respectively. This pattern continues for the remaining six VRAMs such that the last VRAM has its leads connected to leads 28, 29, 30, 31 (not shown) of bus 28.

The VRAM memories 68 are arranged such that the pixel information for the graphics display is stored serially across the planes in the same row. Assuming a 4-bit per pixel system, then the bits for each pixel are stored in separate VRAM memory. In such a situation, pixel 0 would be the first VRAM 68*a* and pixel 1 would be the second VRAM 68*b*. The pixel storage for pixels 2–7 are not shown, but these would be stored in column 1 of VRAMS 68*c, d, e, f, g* and *h*. The pixel information for pixel 8 would be stored in the first VRAM 68*a*, still in row A, but in column 2 thereof.

Each VRAM plane has a serial register 72 for shifting out information from a row of memory. In the preferred embodiment, the shifting out is performed in response to a shift clock signal SCLK (discussed in detail below) generated on palette 42 (FIG. 1). The outputs from these registers are connected to bus 38 in the same manner as the data input leads are connected to input bus 28. Thus, data from a row memory, such as row A, would be moved into register 72 and output serially from each register 72 and in parallel on bus 38. This would occur for each plane of the eight VRAM memory array.

The memory configuration depicted in FIG. 3 is not limited to the handling of 4-bit pixel description data. For example, if the information for each pixel was to be described in eight bits, then two VRAMs 68 would be required per pixel. Further, for increased ability in handling data, shift registers 72 would be split in half with each half used to output data onto bus 38. The split register approach allows for differences in the number of pixels required by the display and the number of bits per pixel desired. In regards to the present embodiment of the invention, it should be noted that in order to accommodate split shift register transfers an extra shift clock pulse must be provided to video RAM 30. This extra pulse is required since split shift register video RAMs, such as the Texas Instruments TMS 44C251 video RAM, generally require a full register transfer from the RAM array to the shift register prior to a split shift register transfer sequence. The extra shift clock pulse is used to load the new tap point for the full register transfer. A more complete description of this feature can be found in co-assigned application Ser. No. 07/544,775 and hence, will not be repeated here.

Returning to FIGS. 1 and 2, graphics processor 18 operates in two different address modes to address memory 20. These two address modes are X-Y addressing and linear addressing. In linear addressing, the start of a field is formed by a single multibit linear address. The field size is determined by the data within a status register within central processing unit 44. In X-Y addressing, the start address is a pair of X and Y coordinate values. The field size is equal to the size of a pixel, that is, the number of bits required to specify the particular data of a particular pixel.

It is important to note that in any event, graphics processor 18 may manipulate data to provide for a variable number of pixels as required by the associated display 26 as well as a variable number of data bits per pixel in each color code. This provides increased flexibility in terms of the size and resolution of display 26 and the number of possible colors available for a given pixel. As will be discussed below in further detail in conjunction with the description of the color palette 42, graphics processor 18 in the illustrated embodiment outputs 32-bit color code words which may provide thirty-two 1-bit, sixteen 2-bit, eight 4-bit, or four 8-bit addresses for each pixel to the lookup table. The more bits that are provided for each address, the more palette locations (i.e., possible colors) are accessible for a given pixel.

Figure 4:
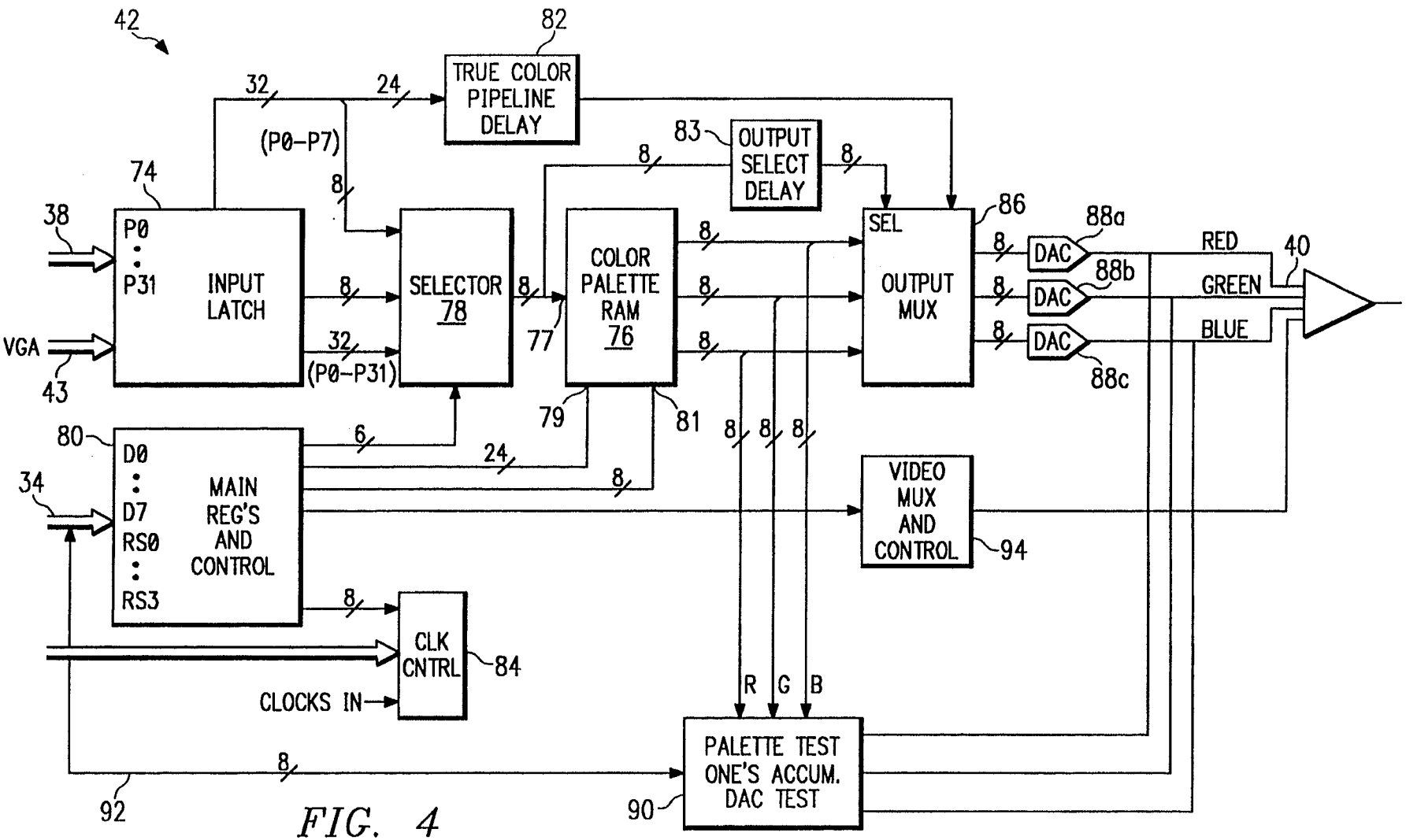
FIG. 4 is a functional, block diagram of a video palette depicted in FIG. 1.

FIG. 4 is a more detailed depiction of palette 42 emphasizing the color palette RAM and the circuitry controlling it. Palette 42 includes an input latch 74 coupled to video memory 20 (FIG. 1) via bus 38. In the illustrated embodiment, input latch 74 receives color codes output from eight VRAM memories 68 comprising video RAM memory 30. Color palette RAM 76 provides color data words in response to color codes received at input latch 74. Selector 78 couples color palette RAM 76 and input latch 74. In the preferred embodiment, selector 78 receives 32 bits of red, green and blue color codes from video RAM 34 via latch 74 and outputs four corresponding 8-bit addresses to port 77 of RAM 76. It is important to recognize however that numerous configurations are possible, such varying numbers of input bits and output bits can be handled. In the preferred embodiment, selector 78 is configurable to receive color codes of either 4, 8, 16 or 32 bits and to output a corresponding number of 1, 2, 4, or 8-bit addresses, each addressing a location in RAM 76, in response. For a more complete description of the operation and timing of selector 78, reference is now made to co-pending and co-assigned application Ser. No. 07/723,342, Attorney's Docket Number TI-15776 incorporated herein by reference.

In the depicted example, RAM 76 is of a 256K×24 bit architecture with each 8-bit address outputting a 24-bit word. The 24-bits output can then provide three 8-bit words of red, blue or green, data for conversion and output by digital to analog converters 88. In the illustrated embodiment color palette RAM 76 is a high speed dual-port static RAM (SRAM), however, color palette RAM 76 may also be implemented using dynamic random access memories (DRAMs).

Graphics processor 18 (FIG. 2) controls the contents of the color data words output to video display 26 in response to color codes received at latch 74 by the reading and writing of color data words into and out of color palette RAM 76 using registers and control circuitry 80 and bus 34. Preferably, ports 79 and 81 of a dual-port RAM is used for this data revision/update function. When a 256×24 bit memory is used, eight bit words of red, green and blue data are written in as a concatenated 24-bit word to port 79 with an 8-bit address provided to port 81 determining the memory location. For a more detailed description of register control circuitry 80 and the preferred methods of reading and writing color data words into color palette RAM 76, refer to co-assigned application Ser. No. 07/720,100 (Attorneys' Docket No. TI-15783) Palette 42 also includes clock control circuitry 84, output multiplexer 86 and digital-to-analog converters 88. Also depicted in FIG. 4 are palette test and accumulator registers 90, analog test registers 92, and video multiplexer and control circuitry 94. For a more complete description of these components, reference is made to pending applications Attorney's Docket Numbers, TI-15123, TI-15783, TI-15776 and TI-16453 incorporated herein by reference.

Palette 42 also is operable in a "nibble mode". The "nibble mode" is used in a system configuration similar to that depicted in FIG. 3 except that graphics processor 18 controls two VRAM's 20*a* and 20*b* instead of only one. VRAM 20*a* has four VRAM sections with 4-bit nibble-wide shift registers 72 operating in parallel to supply 16 bits of output connected to the high four nibbles of each byte of a four-byte wide input latch 74. VRAM 20*b* also has four VRAM sections each with 4-bit nibble-wide outputs and has 16 bits of output connected to the low four nibbles respectively of the 4 bytes of input latch 72. In the nibble mode, palette 42 can switch between VRAM 20*a* and VRAM 20*b*, for example, to switch between two different images. Graphics processor 18 outputs a signal NIBBLE FLAG which directs palette 42 to output to display 26 either the four high nibbles or the four low nibbles. For a complete system level description of this special nibble mode, reference is again made to pending application, Ser. No. 07/544,775.

Color palette 42 is further operable in a true color mode. In the illustrated embodiment in which 32-bit color codes are received on bus 38 from video RAM 30, 24-bits are transferred directly from input latch 74 to digital-to-analog converters 88 through output multiplexer 86. The remaining 8-bits of the 32-bit color code are passed directly through selector 78 to provide an address to color palette 76 for the output of color data for an overlay pixel on video display 26. For a given pixel, graphics processor 18 can select between the true color data or the overlay data using output multiplexer 86. True color pipeline delay 82 provides for the proper synchronization of the of data directly fed to output multiplexer 86 and the overlay data output from color RAM 76 as addressed by the remaining bits of color code word. True color pipeline delay 82 performs this function by adding one latch delay, through clocked flip-flops, to each bit of the true color data for every pipeline delay seen by each bit of the overlay data in the path through selector 78 and RAM 76 to the input of output multiplexer 86. Provision is also made for generating the control signals applied to the select input of output multiplexer 86 to select for output either the true color data or the corresponding overlay color data. Delay circuitry (not shown) insures that the control signal used to select the color data to be output arrives at the select input to multiplexer 86 substantially at the same time the true color and overlay data reach their respective data inputs. For a complete description of the true color operating mode and true color pipeline delay circuitry, reference is made to co-pending and co-assigned patent application Ser. No. 07/790,963, Attorneys Docket Number TI-15777, incorporated herein by reference.

Figure 5:
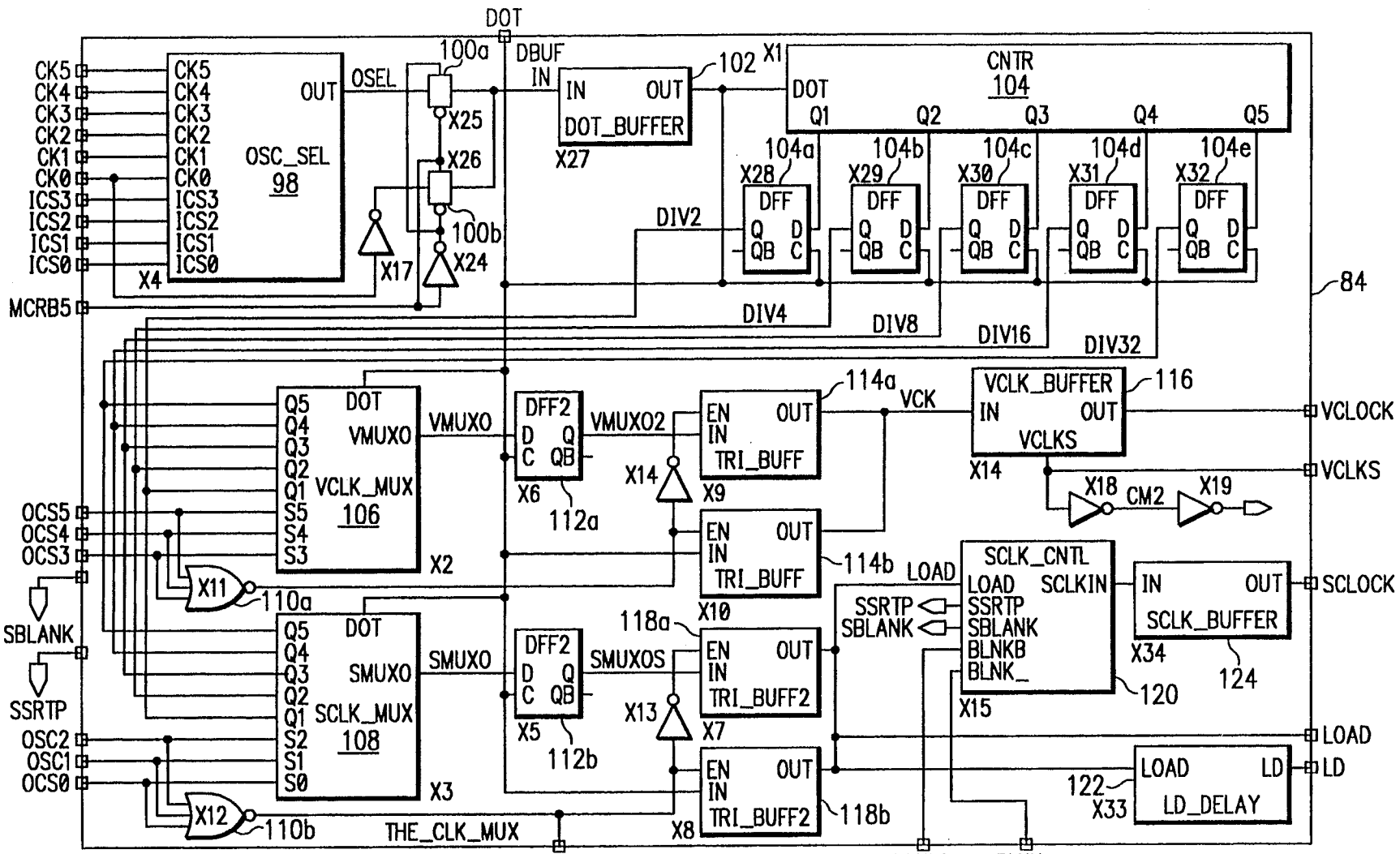
FIG. 5 is a detailed overall block diagram of the clock control circuitry depicted, in FIG. 4.

FIG. 5 is a detailed block diagram of clock control circuitry 84 (also known as the clock multiplexer). In general, clock multiplexer circuitry 84 provides a number of important timing functions for palette 42. Among other things, input clock multiplexer/select circuitry allows for the selection of one of three TTL input oscillator clocks or the selection of a differential ECL clock source. In the alternative, the inputs provided for receiving the differential ECL clock may be used for two additional TTL clock inputs. Clock multiplexer circuitry 84 also provides for the selection of the system video clock (VCLK) and the system shift clock (SCLK) as divisions of the input clock. In the preferred embodiment, the video clock and shift clocks each have a selectable divide ratio of /1, /2, /4, 8, /16, and /32 of the selected input clock. Further, clock multiplexer circuitry 84 provides for blanking disable and split-shift register transfer timing control of the shift clock (SCLK). Finally, it is important to note that pixel data control synchronization with a system master clock (the DOT clock) is independent of the mode of operation of the color palette 42. Each of these functions will be described in further detail as follows.

Figure 6:
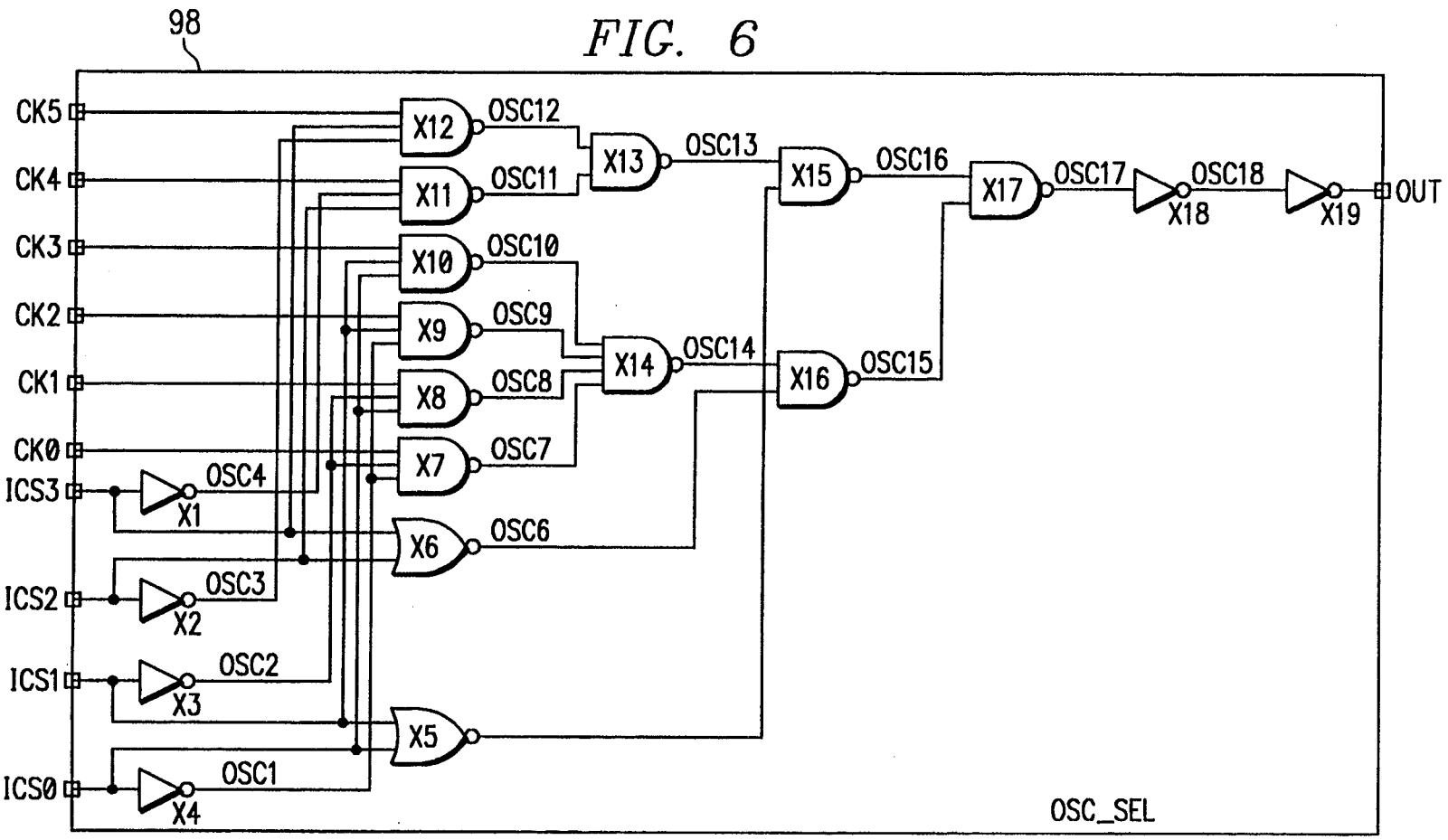
FIG. 6 is a schematic drawing of the oscillator select circuitry shown in FIG. 5.

Oscillator select circuitry 98 is operable to select one of either five TTL clocks or between one of three TTL clocks and one differential ECL input clock received from an external clock source. A detailed schematic drawing of oscillator select circuitry 98 is shown in FIG. 6. Four control bits ICSO0–ICSO3 are received from the input clock selection register of registers and control circuitry 80 for selecting the input clock.

TABLE I

| Input Clock Selection Register Bits (1) | | | | | |
|---|---|---|---|---|---|
| 3 | 2 | 1 | 0 | Hex (1) | Function (2) |
| 0 | 0 | 0 | 0 | 00 | Select Input CK0 |
| 0 | 0 | 0 | 1 | 01 | Select Input CK1 |
| 0 | 0 | 1 | 0 | 02 | Select Input CK2 |
| 0 | 1 | 1 | 1 | 03 | Select Input CK3 |
| 0 | 1 | 0 | 0 | 04 | Select Input CK4 |
| 1 | 0 | 0 | 0 | 08 | Select Input CK5 |

Table 1 cross-references the values of control bits ICS0–ICS3 and the clock input selected. When five TTL clocks are being provided, each input CK0–CK4 is coupled to a corresponding input pin to palette 42. When a differential ECL input clock is desired, however, the pine coupled to inputs CK3 and CK4 are instead both used to receive the ECL signal. The ECL signal is then converted by an ECL to CMOS converter circuit (not shown) into a CMOS compatible signal which is applied to input CK5, which then can be selected as desired in accordance with Table 1.

The output of oscillator select circuitry 98 is gated by a pair of transmission gates 100*a* and 100*b* in response to control signal MCRB5. In the normal operating mode, control MCRB5 is set low and the output from oscillator select circuitry 98 is passed through transmission gate 100*a*. In the VGA mode, however, when control signal MCRB5 is set high, the clock appearing at input CK0 bypasses oscillator select circuitry 98 and is passed directly through transmission gate 100b. This avoids the delay through oscillator select circuitry 98 which may prove critical in the VGA mode where timing requirements are more stringent. Further, it is important to note that the inverse of the signal appearing at input CKO is passed through to meet the VGA latching requirements of selector 78, discussed above. The output of transmission gates 100a and 100b becomes the prebuffered DOT (master clock) for palette 42.

Figure 7:
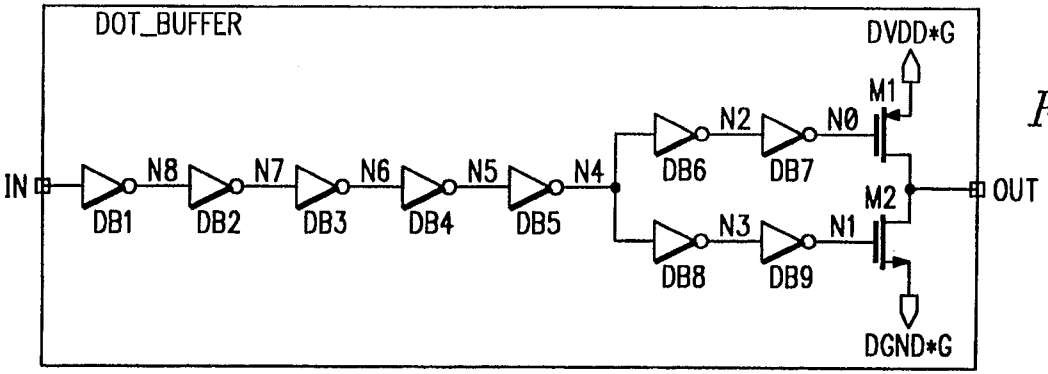
FIG. 7 is a detailed schematic diagram of the DOT clock buffer circuitry shown in FIG. 5.
Figure 8:
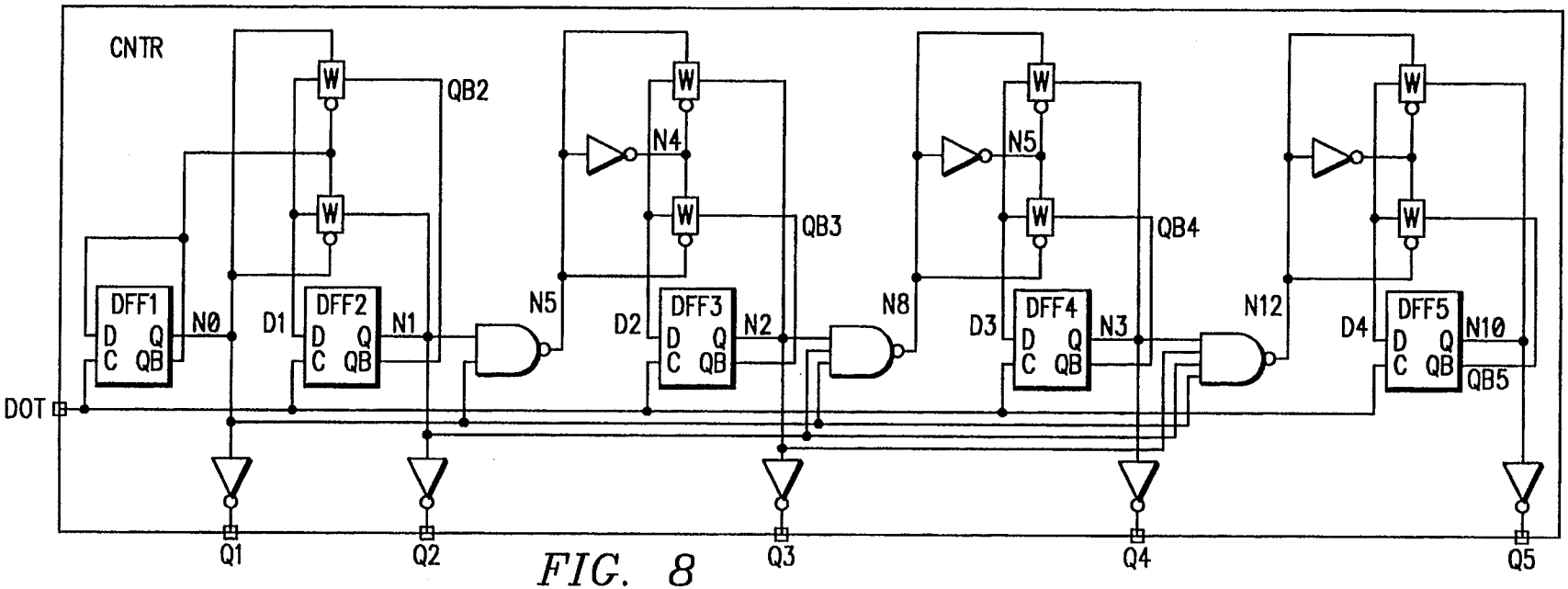
FIG. 8 is a detailed schematic diagram of the counter shown in FIG. 5.

Next, the output of either transmission gate 100a or 100b is provided to the input of DOT clock buffer circuitry 102, a detail schematic of which is provided as FIG. 7. DOT clock buffer circuitry 102 provides the master clock (the DOT clock) to all circuits on color palette 42, as required. DOT clock buffer circuitry 102 has sufficient drive such that no local buffering of the DOT clock is required on palette 42 thereby ensuring that all the circuits running off the DOT clock are presented with the same clock reference independent of distributed loading.

Counter circuitry 104 divides down the selected input clock following buffering by DOT clock buffer circuitry 102. A detailed schematic of counter 104 is provided as FIG. 8. Counter 104 in the illustrated embodiment is a five bit synchronous counter with transmission gates controlling the synchronization by NANDing each of prior stage outputs. Counter 104 continuously provides signals of divide by 2, divide by 4, divide by 8, divide by 16 and divide by 32 divide ratios of the selected DOT clock at outputs Q1–Q5, respectively. Flip-flops 104a–104e, at the outputs Q1–A5 of counter 104 re-clock the divided down signals with the DOT clock to account for any delays through counter 104 which otherwise may later cause a selected video clock or shift clock to miss a corresponding DOT clock edge.

Figure 9:
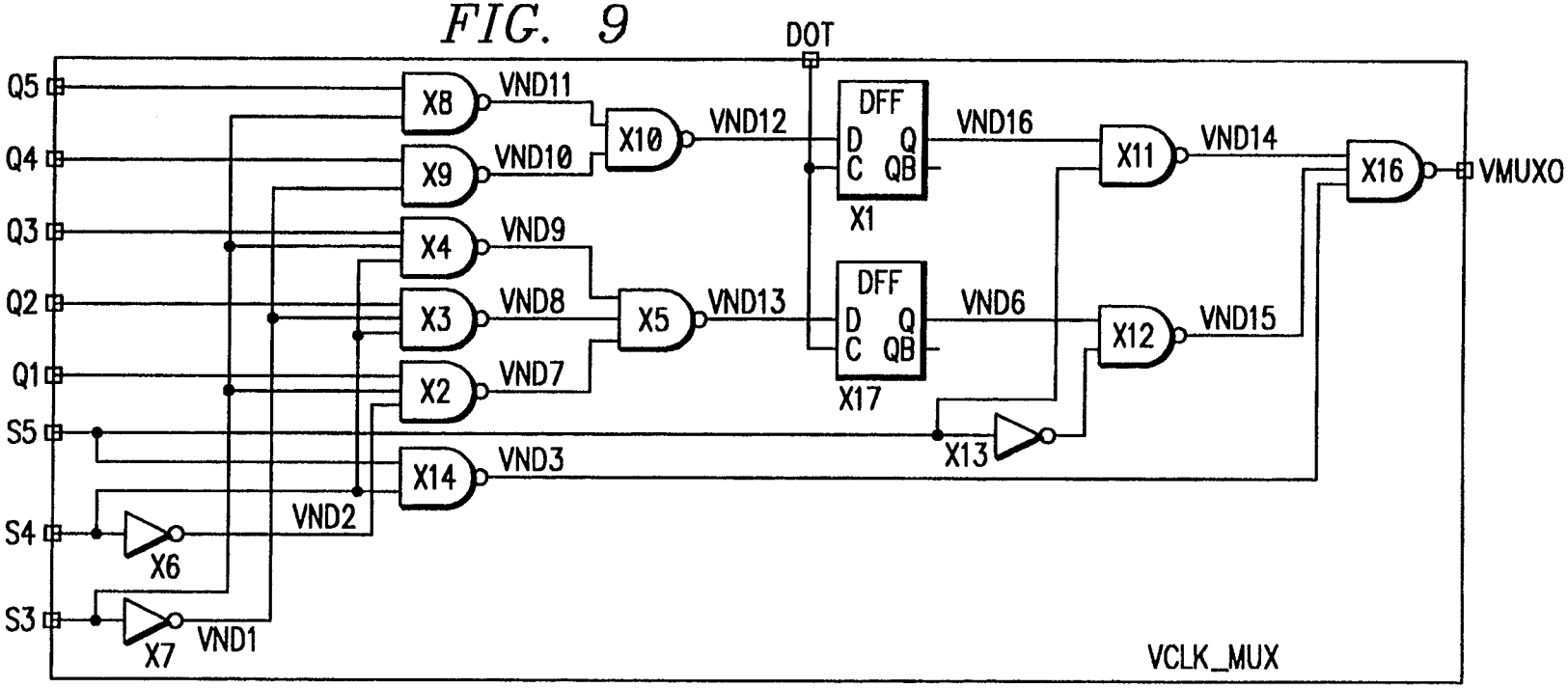
FIG. 9 is a detailed schematic diagram of the video clock multiplexer shown in FIG. 5.
Figure 10:
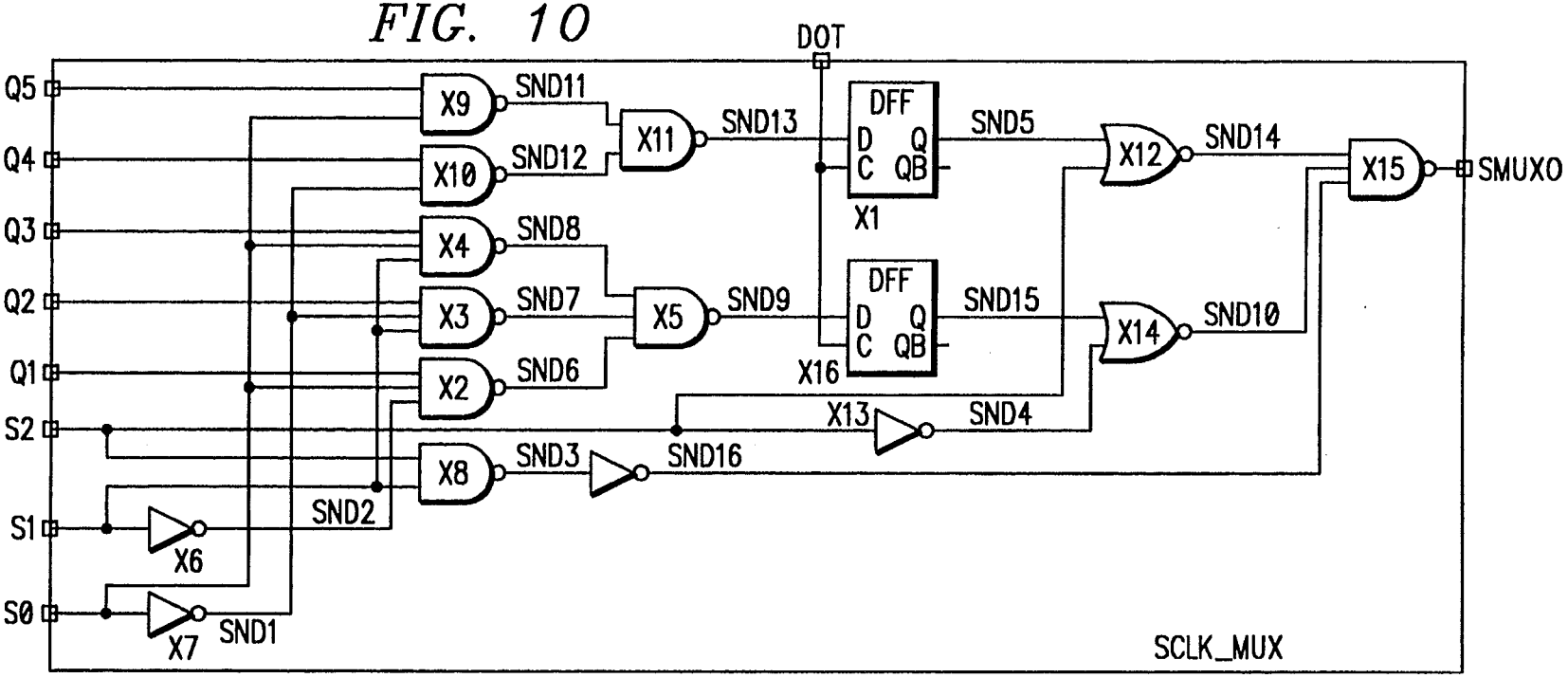
FIG. 10 is a detailed schematic diagram of the shift clock multiplexer shown in FIG. 5.
Figure 11:
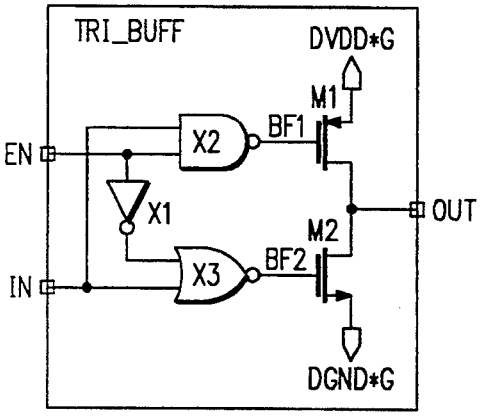
FIG. 11 is a detailed schematic diagram of the video clock tri-state buffer shown in FIG. 5.

The divided down input clock is then passed to the data inputs of video clock multiplexer 106 and shift clock multiplexer 108, detailed schematics of which are provided as FIGS. 9 and 10, respectively. Six bits OCS-0–OCS5 are received from the output clock selection register of registers and control circuitry 80 which controls both the selection of the system video clock and the system shift clock from the available divide ratios of the input clock. The selections are made in accordance with Table 2.

TABLE II

| Output Clock Selection Register Bits (1) | | | | | | |
|---|---|---|---|---|---|---|
| 5 | 4 | 3 | 2 | 1 | 0 | Function (2) |
| 0 | 0 | 0 | x | x | x | VCLK/1 output ratio |
| 0 | 0 | 1 | x | x | x | VCLK/2 output ratio |
| 0 | 1 | 0 | x | x | x | VCLK/4 output ratio |
| 0 | 1 | 1 | x | x | x | VCLK/8 output ratio |
| 1 | 0 | 0 | x | x | x | VCLK/16 output ratio |
| 1 | 0 | 1 | x | x | x | VCLK/32 output ratio |
| 1 | 1 | x | x | x | x | VCLK output held at Logic 1 |
| x | x | x | 0 | 0 | 0 | SCLK/1 output ratio |
| x | x | x | 0 | 0 | 1 | SCLK/2 output ratio |
| x | x | x | 0 | 1 | 0 | SCLK/4 output ratio |
| x | x | x | 0 | 1 | 1 | SCLK/8 output ratio |
| x | x | x | 1 | 0 | 0 | SCLK/16 output ratio |
| x | x | x | 1 | 0 | 1 | SCLK/32 output ratio |
| x | x | x | 1 | 1 | x | SCLK output switched off and held low |

It should be noted that NOR gates 110a and 110b (FIG. 5) detect the selection of a video clock or a shift clock which is equal to the DOT clock. In either of these cases, the corresponding video clock multiplexer 106 or shift clock multiplexer 108 is bypassed and the DOT clock directly sent for output buffering (in the case of the video clock) or further output control (in the case of the shift clock). This configuration avoids unnecessary delays of the DOT clock through video clock multiplexer 106 and/or shift clock multiplexer 108 when either the shift clock or the video clock, or both, equals the high speed DOT clock.

The outputs of video clock multiplexer 106 and shift clock multiplexer 108 are next re-clocked to the DOT clock by flip-flops 112a and 112b to account for propagation delays through multiplexer 106 and multiplexer 108. Tri-state buffers 114a and 114b select for output, as the video clock, between the divided down input clock as passed through video clock multiplexer 106 and re-clocked by flip-flop 112a, and the DOT clock provided directly from DOT clock buffer circuitry 102 (when the DOT clock equals the video clock). A detailed schematic drawing of tri-state buffers 114a and 114b is provided as FIG. 11.

Video clock buffer circuitry 116 receives the selected output from either tri-state buffer 114a or tri-state buffer 114b and provides the necessary drive for the system video clock signal VCLOCK and associated signal VCLKS. A detailed schematic of the video clock buffer 116 is provided as FIG. 12.

Figure 13:
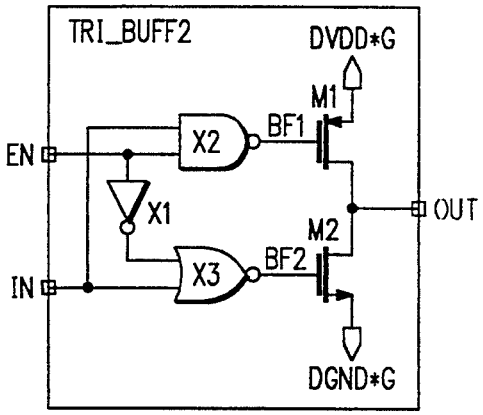
FIG. 13 is a detailed schematic diagram of the shift clock tri-state buffers shown in FIG. 5.
Figure 12:
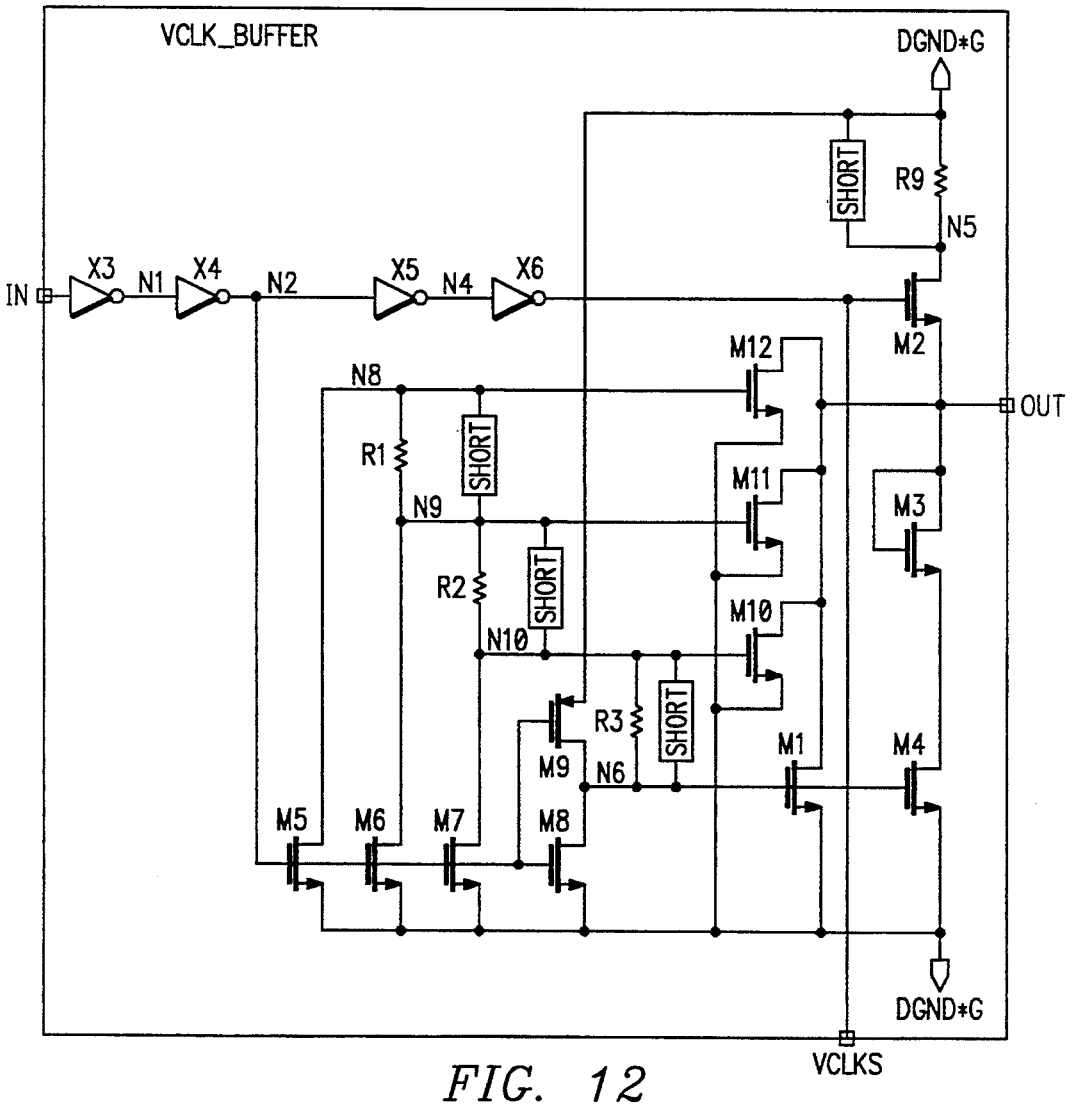
FIG. 12 is a detailed schematic diagram of the video clock buffer shown in FIG. 5.
Figure 14:
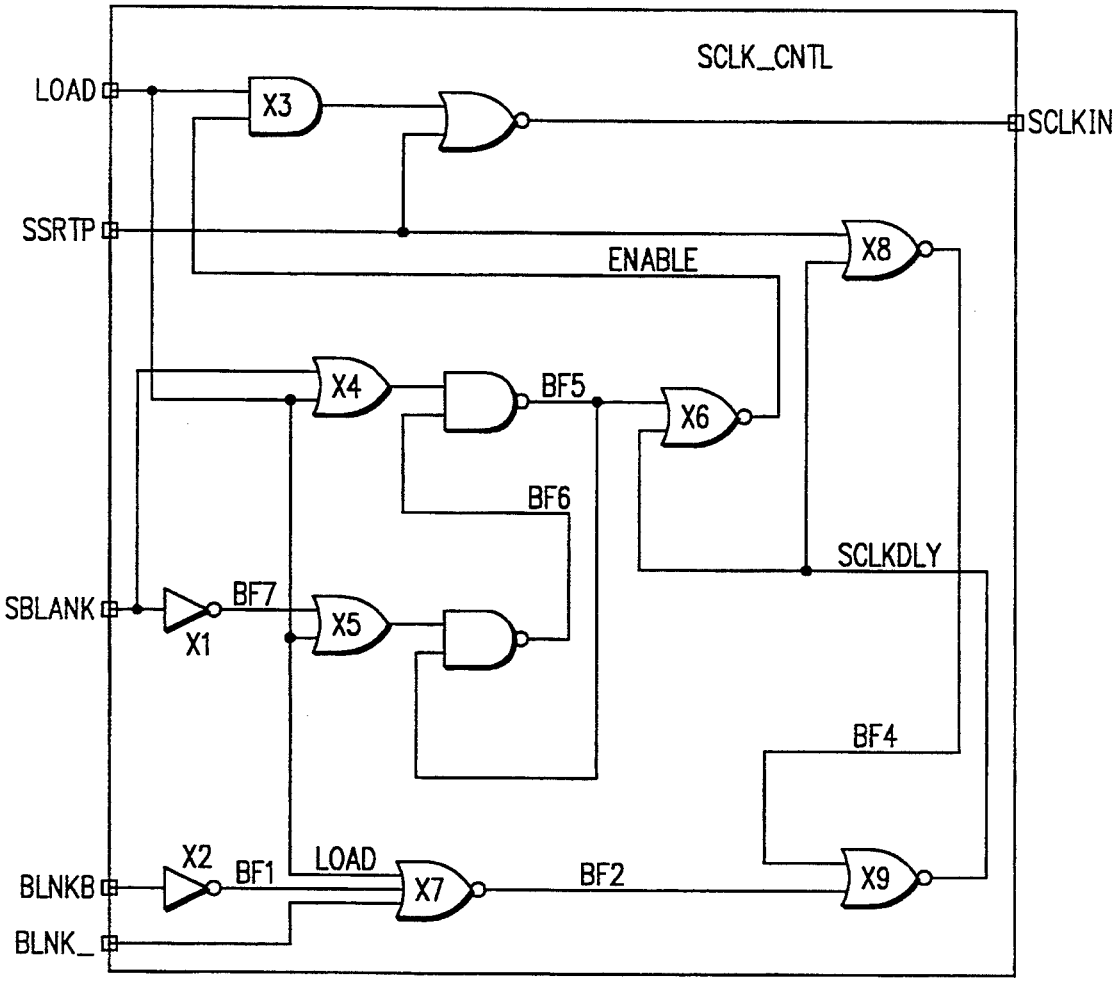
FIG. 14 is a detailed schematic diagram of the shift clock control circuitry shown in FIG. 5.
Figure 15:
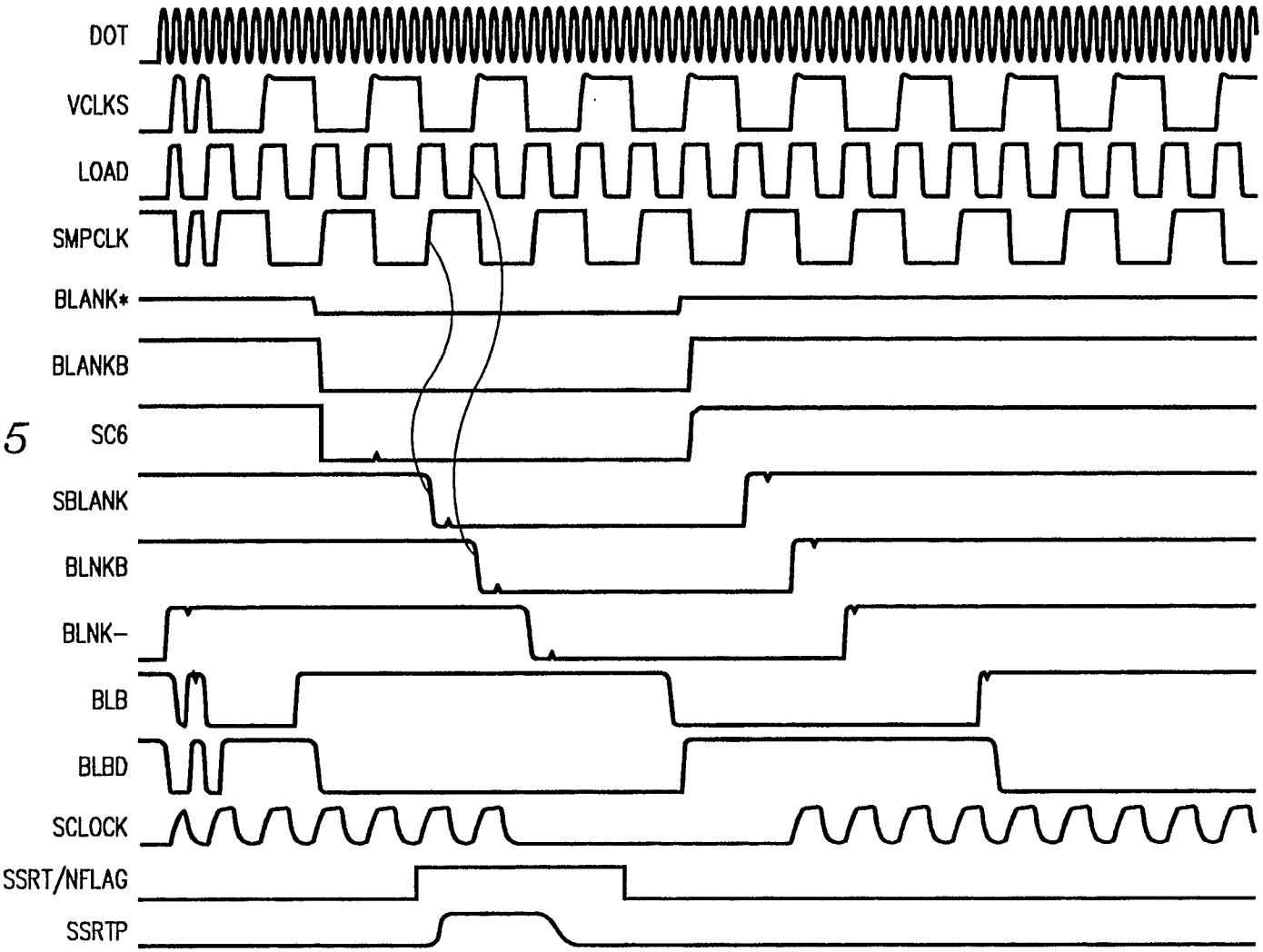
FIG. 15 is a timing diagram depicting the relationship between the system data clocks and the display blanking and synchronization signals.
Figure 17:
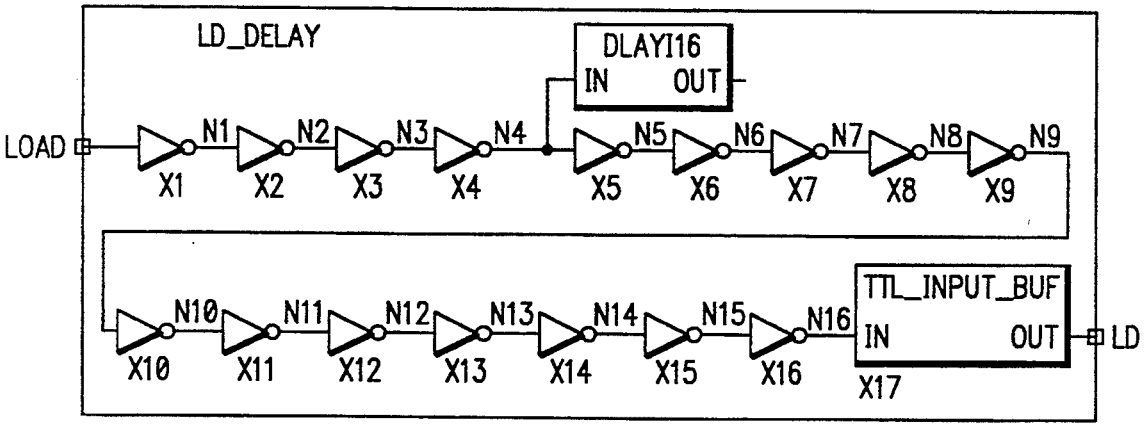
FIG. 17 is a detailed schematic diagram of the LD delay circuitry shown in FIG. 5.
Figure 18:
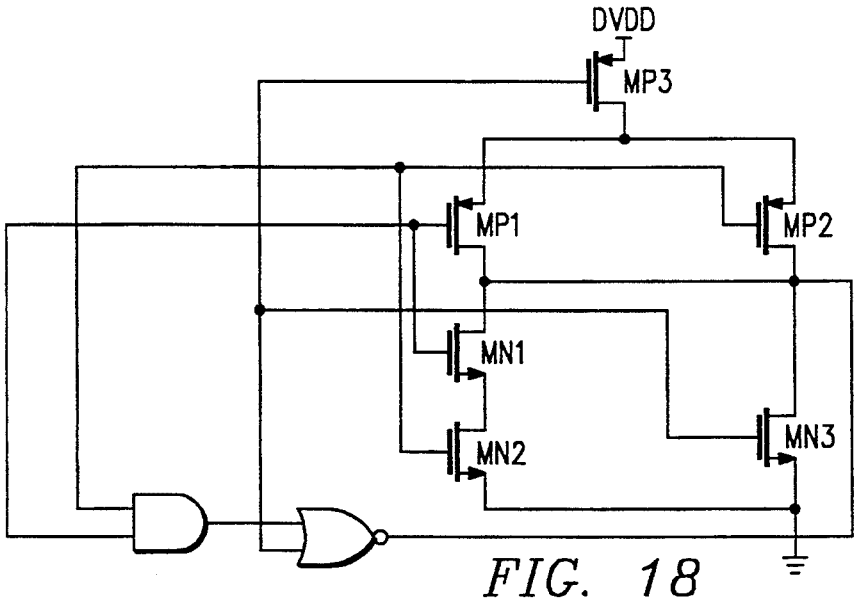
Figure 19:
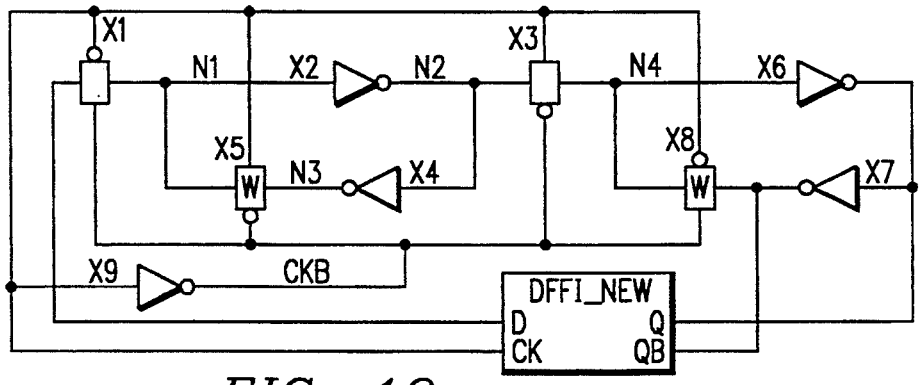
Figure 20:
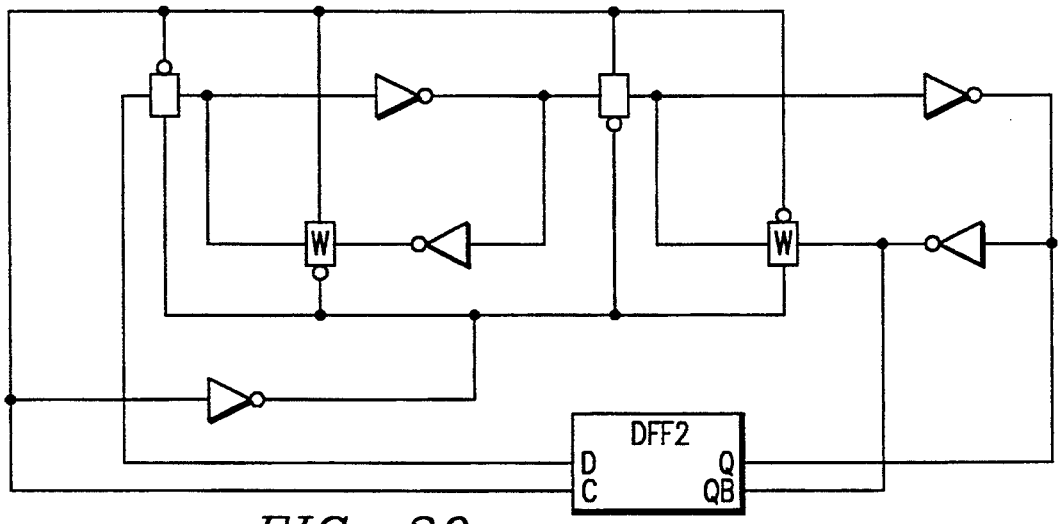

Tri-state buffers 118a and 118b select between the available divided down DOT clock signals as selected by shift clock multiplexer 108 and re-clocked by flip-flop 112b, and the DOT clock provided directly from DOT clock buffer circuitry 102 (when the shift clock equals DOT clock). A detailed electric schematic diagram of tri-state buffers 118a and 118b is provided as FIG. 13. The selected output is designated as a control signal Control signal LOAD is fed in parallel to shift clock control circuitry 120 and LD delay circuitry 122. An electrical schematic of shift clock control circuitry 120 is provided as FIG. 14 (a detailed schematic of LD delay circuitry 122 is provided as FIG. 17). Control signal LOAD is essentially the same as the shift clock, except LOAD is not disabled during display blanking as is the shift clock, discussed further below. Signal LOAD is used, among other things, for latching data in input latches 74 and selector 78.

Figure 16:
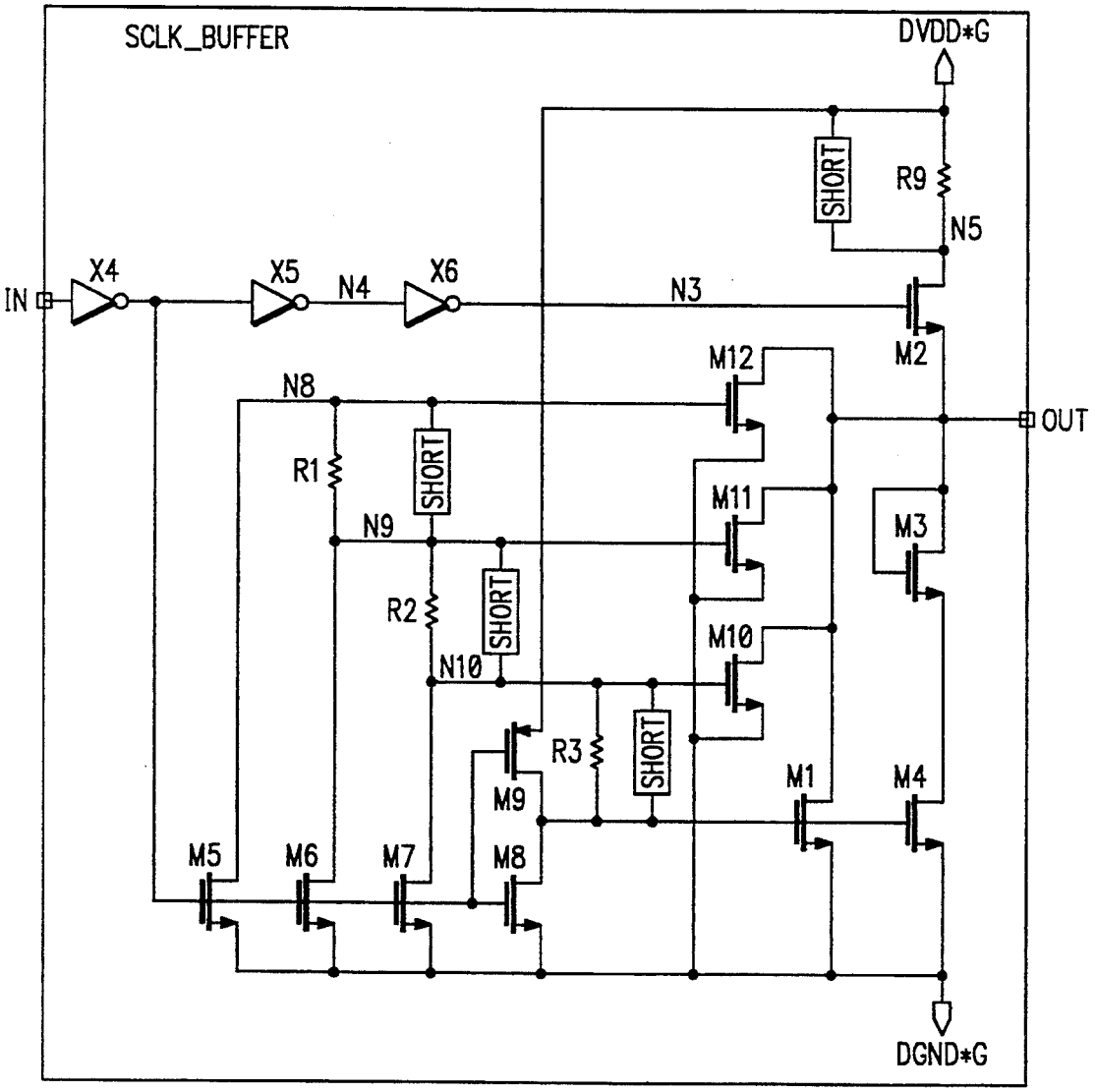
FIG. 16 is a detailed schematic diagram of the shift buffer shown in FIG. 5.

Since the shift clock controls the transfer of video data from system video memory 30 to color palette 42, the control of the shift clock during the blanking interval for the display is critical to avoid the dropping or wrap around of pixel data. Shift clock control circuitry receives control signals SBLANK (sampled blank) and blanking signals BLNK- and BLNKB from multiplexer and control circuitry 94. Video multiplexer and control circuitry 94 receives display blanking and synchronization signals (BLANK-, VSYNC, HSYNC, VGA-BLANK-) from processor 18 and synchronizes them with the pixel input data clocks (LOAD, LD, VCLKS) generated by clock control circuitry 84. Video control circuitry 94 provides clock control circuitry 84 in return with signals SBLANK, BLNK- and BLNKB. The timing relationship between these signals is depicted in FIG. 16. For a complete description of the generation of video control and synchronization signals, reference is again made to co-pending and coassigned application Ser. No. 07/544,775, incorporated herein by reference.

Sampled blank signal (SBLANK) goes low at the start of the blanking cycle. On the following rising edge of signal LOAD, the shift clock (SCLOCK) is disabled. At the end of the blanking cycle, SBLANK returns high and on the next rising edge of LOAD, SCLOCK is again enabled. When graphics processor 18 requires video RAM 30 to execute a split shift register transfer, a signal SSRT/NFLAG is sent to color palette 42. Video multiplexer and control circuitry 94 in response generates a control pulse SSRTP during the period when SBLANK is low and provides the SSRTP signal to shift clock control circuitry 120. The split shift register transfer pulse (SSRTP) sets the output enable signal for one LOAD cycle enabling the output of an additional period of the shift clock even though SBLANK has gone low. To account for the extra shift clock pulse, shift clock control circuitry 120 then delays the re-enable of the shift clock by one clock period (essentially subtracting a pulse). This delay is preformed in accordance with the timing of signals SBLANK, BLNK- and BLNKB, each of which is an additional one shift clock period out from the previous signal (see FIG. 16).

SCLOCK buffer 124 provides the necessary output drive for the shift clock SCLOCK. A detailed schematic diagram of shift clock buffer 120 is provided as FIG. 17. LD delay circuitry provides a control signal LD, for use on color palette 42, which is close time wise to the shift clock. A detailed electrical schematic diagram LD delay circuitry 122 is provided as FIG. 17.

Although the present invention has been described in detail it should be understood that various changes, substitutions and alterations can be made hereto without departing from the spirit and scope of the invention as defined by the appended claims.

What is claimed is:

1. A clock control circuit comprising:

circuitry for selecting a master clock from among at least two input clocks provided to said clock control circuit, said selection made in response to master clock selection control signals received by said clock control circuit;

circuitry coupled to said circuitry for selecting said master clock for providing at least first and second divided down clocks, each said first and second clocks being of a different divide ratio of said master clock;

circuitry coupled to said circuitry for providing divided down clocks for selecting an output clock from between at least said first and second divided down clocks in response to output clock selection control signals received by said clock control circuit;

circuitry coupled to said circuitry for selecting an output clock for selectively controlling said output clock, said circuitry for selectively controlling said output clock enabling said output clock in response to a first output clock output control signal received by said clock control circuitry and disabling said output clock in response to a second output clock output control signal received by said clock control circuit; and circuitry coupled to said circuitry for selectively controlling for selectively outputting an additional output clock cycle in response to a control signal during a period when said circuitry for selectively controlling has disabled said output clock.

2. The clock control circuit of claim 1 wherein said circuitry for selecting a master clock comprises a multiplexer circuit having at least first and second data inputs for receiving at least said first and second input clocks and at least one control input for receiving said master clock selection control signal.

3. The clock control circuitry of claim 1 wherein said circuitry for providing divided down clocks comprises a counter.

4. The clock control circuitry of claim 3, wherein said counter comprises a synchronous counter clocked by said master clock.

5. The clock control circuitry of claim 3 wherein said circuitry for selecting an output clock comprises a multiplexer circuit including a least first and second data inputs coupled to said counter for receiving said first and second divided down clocks and at least one control input for receiving said output clock selection control signals.

6. A clock control circuit comprising:

a plurality of clock input terminals;

a plurality of input clock select control terminals;

a plurality of output clock select control terminals;

a split shift register transfer control terminal;

a plurality of blanking control terminals;

input clock select circuitry coupled to said clock input terminals and said input clock select control terminals for selecting an input clock signal from among a plurality of clock signals received at said clock input terminals;

a counter coupled to said input clock select circuitry for generating a plurality of second clock signals each having a clock frequency of a selected divide ratio of said input clock;

output clock select circuitry coupled to said counter and said output clock select control input terminals for selecting an output clock from among said plurality of second clock signals generated by said counter;

output clock control circuitry coupled to said output clock select circuitry, said split shift register transfer control terminal and said blanking control terminals, said output clock control circuitry operating to enable an output of said output clock in response to first blanking data applied to said blanking control input terminals and disable the output of said output clock in response to second blanking data applied to said blanking control input terminals, said output clock control circuitry further operating to provide an additional period of said output clock in response to a split shift register transfer pulse received at said split shift register transfer pulse terminal during a period when said output clock is disabled.

7. The clock control circuitry of claim 6 wherein said output clock control circuitry is further operating to delay the enabling of the output of said output clock by one period of said output clock following the receipt of said first control data after a said split shift register pulse has passed through an additional period of said clock control circuitry.

8. The clock control circuitry of claim 7 and further comprising an output buffer coupled to said clock control circuitry for buffering and outputting a said output clock received from said output clock control circuitry.

9. The clock control circuitry of claim 7 and further comprising output gating circuitry coupled to said input clock select circuitry, said output clock select circuitry and said output clock control circuitry, said output gating circuitry operating to pass said input clock to said clock control circuitry in response to a first gating control signal and said output clock signal to said output clock control circuitry in response to a second gating control signal.

10. The clock control circuitry of claim 8 and further comprising delay circuitry coupled to said output clock select circuitry for providing a clock signal substantially in phase with said output clock output by said output buffer circuitry.

11. The clock control circuitry of claim 6 and further comprising:

second output clock output clock select circuitry coupled to said counter and said output clock select control input terminals for selecting a second output clock from among said plurality of second clock signals generated by said counter; and second output buffering circuitry coupled to said second clock output select circuitry for buffering and outputting said second output clock.

12. The clock control circuitry of claim 11 and further comprising second output gating circuitry coupled to said input clock select circuitry, said second output clock select circuitry and said second output buffer circuitry, said second output gating circuitry operating to pass said input clock to second output buffer circuitry in response to a first gating control signal and said second output clock signal to said second output buffering circuitry in response to a second gating control signal.

13. A color palette clock control circuit comprising:

a plurality of clock input terminals;

a plurality of input clock select control terminals;

a plurality of output clock select control terminals;

a split shift register transfer control terminal;

a plurality of blanking control terminals;

input clock select circuitry having a plurality of first inputs coupled to said clock input terminals, a plurality of second inputs coupled to said input clock select control terminals and an output, said input clock select circuitry operating to pass an input clock signal received at a selected one of said first inputs to said output in response to an input clock select word received at said second inputs;

a counter having an input coupled to said output of said input clock select circuitry and a plurality of counter outputs, said counter providing at each said counter output a divided down clock signal having a clock frequency of a selected divide ratio of said input clock;

shift clock select circuitry having a plurality of first inputs coupled to said counter outputs, a plurality of second inputs coupled to at least some of said output clock select control terminals, and an output, said shift clock select circuitry operating to select a shift clock from among said plurality of divided down clock signals provided at said plurality of counter outputs in response to a shift clock select word received at said second inputs; and shift clock control circuitry coupled to said output of said shift clock select circuitry, said split shift register transfer control terminal and said blanking control input terminals, said shift clock control circuitry operating to enable said shift clock in response to first blanking data applied to said blanking control input terminals and disable the output of said shift clock in response to second blanking data applied to said blanking control input terminals, said shift clock control circuitry further operating to pass through an additional period of said shift clock in response to a split shift register transfer pulse received at said split shift register transfer control terminal during a period when said output clock of said shift is disabled.

14. The clock circuitry of claim 13 wherein said shift clock circuitry operates to subtract a quantity equal to a period of said shift clock after said pass through of said additional period of said shift clock.

15. The clock control circuit of claim 14 and further comprising video clock select circuitry having a plurality of first inputs coupled to said outputs of said counter and a plurality of second inputs coupled to at least some of said output clock control terminals, said video clock select circuitry operating to select a video clock from among said plurality of divided down clock signals provided at said counter outputs in response to a video clock select word received at said second inputs.

16. The clock control circuitry of claim 15, and further comprising input clock gating circuitry having a first input coupled to said output of said input clock select circuitry, a second input coupled to a preselected one of said input clock terminals, at least one input clock gating control input and an output coupled to said input of said counter, said input clock gating circuitry operating to select said input clock output by said input clock select circuitry in response to a first control signal applied to said input clock gating control input and a input clock signal appearing at said preselected one of said input clock terminals in response to a second control signal applied to said input clock gating control input.

17. The clock control circuitry of claim 16 and further comprising shift clock gating circuitry having a first input coupled to said output of said shift clock select circuitry, a second input coupled to said output of said master clock gating circuitry, at least one shift clock gating control input, and a shift clock gate output coupled to said shift clock control circuitry, said shift clock gating circuitry operating to couple to said shift clock control circuitry a master clock appearing at said master clock output in response to a first control signal applied to said shift clock gating control input and a said shift clock appearing at said output of said shift clock select circuitry in response to a second control signal applied to said shift clock gating control input.

18. The clock control circuitry of claim 17 and further comprising video clock gating circuitry having a first input coupled to said output of said video clock select circuitry, a second input coupled to said master clock output of said master clock gating circuitry, a video clock gating control input and a video clock gate output, said video clock gating circuitry operating to output a master clock appearing at said master clock output in response to a first control signal applied to said video clock gate control input and a said video clock output from said video clock select circuitry in response to a second control signal applied to said video clock gate control input.

19. The clock control circuitry of claim 18 and further comprising master clock buffering circuitry coupling said output of said master clock gating circuitry and said inputs of said shift clock gating circuitry and said video clock gating circuitry.

20. The clock control circuitry of claim 19 and further comprising video clock buffering circuitry coupled to said output of said video clock gating circuitry.

21. The clock control circuitry of claim 20 and further comprising shift clock buffering circuitry coupled to said output of said shift clock control circuitry.

22. The clock control circuitry of claim 21 and further comprising re-clocking circuitry coupled to said counter outputs.

23. The clock control circuitry of claim 22 and further comprising delay circuitry coupled to said output of said shift clock gating circuitry for outputting clock signal substantially synchronous with a said shift clock output from shift clock buffering circuitry.

24. A method of providing clock signals in a color palette operating in association with a video random access memory having split shift register transfer capability comprising the steps of:

passing an input clock signal received at a selected one of a plurality of first inputs of a first selector to an output of said first selector in response to an input clock select word received at second inputs of the first selector;

providing a plurality of divided down clock signals each having a clock rate of a preselected divide ratio of said input clock signal using a counter coupled to the output of the first selector;

selecting a shift clock from among the plurality of divided down clock signals provided by the counter using a second selector circuit having first inputs coupled to outputs of the counter in response to a shift clock select word received at second inputs to the second selector;

selectively outputting the shift clock using shift clock control circuitry coupled to the second selector circuit, said step of selectively outputting the shift clock comprising the substeps of:

enabling an output of the shift clock in response to first blanking data applied to blanking control terminals of the shift clock control circuitry; and disabling the output of the shift clock in response to second blanking data applied to blanking control terminals of the shift clock control circuitry; and outputting an additional period of the shift clock through said shift clock control circuitry in response to a pulse indicating a split shift register transfer in the video random access memory during a period when output of the shift clock is disabled.

25. The method of claim 24 and further comprising the step of subtracting a quantity equal to a period of the shift clock following the output of the additional period of the shift clock during the period when the shift clock is disabled.

* * * * *